US006235688B1

(12) United States Patent
Small et al.

(10) Patent No.: US 6,235,688 B1
(45) Date of Patent: May 22, 2001

(54) DETERGENT CONTAINING LITHIUM METAL HAVING IMPROVED DISPERSANCY AND DEPOSIT CONTROL

(75) Inventors: Vernon R. Small, Rodeo, CA (US); Jean-Louis Le Coent, Le Havre (FR); Gerrit J. Polhaar, Hoogvliet Rt (NL); Ita Suharti Suwandi, Hercules; William Woodford Willis, Jr., Pinole, both of CA (US)

(73) Assignee: Chevron Chemical Company LLC, San Francisco, CA (US)

( * ) Notice: Subject to any disclaimer, the term of this patent is extended or adjusted under 35 U.S.C. 154(b) by 0 days.

(21) Appl. No.: 08/936,278

(22) Filed: Sep. 24, 1997

Related U.S. Application Data

(63) Continuation-in-part of application No. 08/644,995, filed on Mar. 14, 1996, now Pat. No. 5,677,270.

(51) Int. Cl.[7] ..... C10M 159/20

(52) U.S. Cl. ..... 508/390; 508/391; 508/518; 508/572; 508/574; 508/586

(58) Field of Search ..... 508/391, 518, 508/586, 390

(56) References Cited

U.S. PATENT DOCUMENTS

| | | | |
|---|---|---|---|
| 2,951,808 | 9/1960 | Norton et al. | 252/18 |
| 3,351,552 | 11/1967 | Le Suer | 252/41 |
| 3,492,229 | 1/1970 | Weiss | 252/25 |
| 3,554,945 | 1/1971 | Andress et al. | 252/52 |
| 3,634,240 | 1/1972 | O'Halloran | 252/32.7 R |
| 3,711,407 | 1/1973 | Plumstead | 252/41 |
| 3,985,662 | 10/1976 | Campbell et al. | 252/41 |
| 3,990,979 | 11/1976 | Brewster | 252/41 |
| 4,012,330 | 3/1977 | Brewster | 252/33.6 |
| 4,129,508 | 12/1978 | Friihauf | 252/33 |
| 4,176,075 | 11/1979 | Alexander et al. | 252/42.1 |
| 4,210,541 | 7/1980 | Mann | 252/32.7 E |
| 4,302,342 | 11/1981 | Demoures et al. | 252/33.2 |
| 4,326,972 | 4/1982 | Chamberlin | 252/33.3 |
| 4,497,931 | 2/1985 | Hollis | 524/570 |
| 4,797,217 | 1/1989 | Cleverley | 252/42.7 |
| 4,867,891 | 9/1989 | Hunt | 252/33 |
| 4,952,328 | 8/1990 | Davis et al. | 252/32.7 |
| 5,030,687 | 7/1991 | Leone | 252/40 |
| 5,464,548 | 11/1995 | Cahoon et al. | 252/18 |
| 5,486,300 | 1/1996 | Salomon et al. | 252/18 |
| 5,490,945 | 2/1996 | Smith et al. | 252/18 |
| 5,510,043 | 4/1996 | Inoue | 252/42.7 |
| 5,677,270 * | 10/1997 | Small, Jr. et al. | 508/574 |

FOREIGN PATENT DOCUMENTS

| | | | |
|---|---|---|---|
| 0 168 111 | 1/1986 | (EP) | C07C/149/40 |
| 0 462 762 | 12/1991 | (EP) | C10M/159/24 |
| 0 465 118 | 1/1992 | (EP) | C10M/141/10 |
| 0 731 159 | 9/1996 | (EP) | C10M/159/20 |
| 0731159 A2 | 9/1996 | (EP) | C10M/159/20 |
| 0747465 A2 | 12/1996 | (EP) | C10M/163/00 |
| 0747465 A3 | 1/1997 | (EP) | C10M/163/00 |
| 0731159 A3 | 5/1997 | (EP) | C10M/159/20 |
| 0808830 A2 | 11/1997 | (EP) | C07C/323/20 |
| 0808830 A3 | 4/1998 | (EP) | C07C/323/20 |
| 2 305 494 | 3/1975 | (FR) | C10M/1/08 |
| 845 624 | 8/1960 | (GB) . | |
| 1 365 311 | 8/1974 | (GB) | C10M/1/40 |
| 1 481 553 | 8/1977 | (GB) | C10M/1/40 |
| 87/01722 | 3/1987 | (WO) | C10M/163/00 |
| 90/15124 | 12/1990 | (WO) | C10M/141/00 |
| 92/18587 | 10/1992 | (WO) | C10M/159/20 |
| 92/18588 | 10/1992 | (WO) | C10M/163/00 |
| 93/23504 | 11/1993 | (WO) | C10M/163/00 |
| 93/23505 | 11/1993 | (WO) | C10M/163/00 |
| 95/34619 | 12/1995 | (WO) | C10M/163/00 |

* cited by examiner

*Primary Examiner*—Ellen M. McAvoy
(74) *Attorney, Agent, or Firm*—Walter L. Stumpf; Richard J. Sheridan

(57) ABSTRACT

Non-thixotropic, sodium-free lubricant additive having from 10% to 50% of a liquid organic diluent and from 30% to 90% of a substituted hydrocarbaryl metal salt. At least 30 mole percent of the metal in the metal salt is lithium, and the salt is essentially free of sodium. The BN of the non-thixotropic lubricant additive attributable to the lithium is less than 150. This additive is useful for decreasing black sludge deposits and piston deposits.

32 Claims, No Drawings

DETERGENT CONTAINING LITHIUM METAL HAVING IMPROVED DISPERSANCY AND DEPOSIT CONTROL

This application is a Continuation-In-Part of U.S. Ser. No. 08/644,995, filed Mar. 14, 1996, entitled "Methods for Preparing Normal and Overbased Phenates," now U.S. Pat. No. 5,677,270, which is hereby incorporated by reference in its entirety for all purposes.

The present invention relates to novel compositions comprising a substituted hydrocarbaryl lithium salt. In a further aspect, the invention relates to methods of preparing these compositions and their uses as deposit inhibitors and dispersancy improvers in lubricating oils. In another aspect, the invention relates to concentrates and lubricating oil formulations containing such novel compositions.

BACKGROUND OF THE INVENTION

There are many patent documents that teach processes for making alkali metal-containing compounds. Among these are Great Britain Patent Application No. 1,481,553, European Patent Application Nos. 168,111; 462,762; and 465,118; and U.S. Pat. Nos. 4,302,342 and 4,867,891. Although lithium is disclosed as a possible alkali metal in making many of these compounds, in most of these formulations potassium and especially sodium are taught as preferred metals. In none of these above patents are processes to make lithium-containing compounds specifically exemplified.

There are also patent documents that teach lithium containing compounds are useful in lubricating oil compositions. U.S. Pat. Nos. 3,351,552; 3,634,240; 3,990,979; and 4,012,330 are examples of patents that teach lithium succinates as corrosion inhibitors in lubricating oil compositions.

U.S. Pat. No. 3,990,979 teaches half lithium salts of aliphatic hydrocarbon substituted succinic anhydrides and acids, which are reacted with polyhydric alcohols to provide an effective rust and corrosion inhibiting additive. These half lithium salts can be solubilized with alkyl phenols as a solvent aid in a physical mixture to prevent gelling, possibly forming a lithium phenate complex.

U.S. Pat. No. 2,951,808 teaches thixotropic mono- and di-metal salts of salicylic acids as oxidation inhibitors in lubricating oil compositions, preferably in greases. While the salicylic acids can have $C_1$–$C_{15}$ alkyl groups, all the examples teach salicylic acids that are free of alkyl groups. The metal salts can be lithium or sodium salts.

U.S. Pat. No. 4,176,075 teaches a grease formulation similar to U.S. Pat. No. 2,951,808, which also contain a dioxime compound. The metal salts can be lithium or sodium, and are thixotropic.

U.S. Pat. No. 3,711,407 teach suspensions of oil-insoluble lithium salts of salicylic acid prepared by saponifying an aliphatic alcohol ester of hydroxy benzoic acid and then removing water and alcohol formed in the reaction.

U.S. Pat. No. 4,497,931 teaches polymer compositions stabilized by the presence of soluble lithium ions. These compositions are formed from a molten mixture of polymer, antioxidant, and a lithium compound.

U.S. Pat. No. 3,492,229 teaches certain base fluids that are oxidatively stabilized by certain metal salts. The metal can be any alkali metal or bismuth or lanthanum. Specific lithium-ontaining compounds taught (Table I) are the phenoxy benzoate and phenyl azobenzoate.

There are many grease compositions that use lithium compounds, especially lithium salts of hydroxy fatty acids, as a thickener. For example, the above mentioned U.S. Pat. No. 2,951,808 teaches a mixed lithium/calcium soap of 12-hydroxy stearic acid.

U.S. Pat. No. 3,985,662 teaches grease compositions using a lithium methyl salicylate soap. Lithium methyl salicylate soaps are thixotropic solids.

There are a few patents that teach processes for making lithium-containing compounds used as lubricating oil detergents.

U.S. Pat. No. 4,797,217 teaches a process for making overbased lithium sulfonates from lithium hydroxide monohydrate (BN of at least 250). Control of water removal is described as being important to the process. It does not teach any specific formulations containing these compounds.

World Patent No. 92/18,587, in Example 9, teaches an overbased lithium carboxylate. It does not teach any specific formulations including this compound.

European Patent Application No. 731159 teaches overbased lithium sulfonates that have a BN of at least 240.

There are also many patent documents that teach formulations of alkali metal-containing compounds. Examples of these include U.S. Pat. Nos. 4,326,972; 4,952,328; 5,464,548; 5,486,300; and 5,490,945; and World Patent Nos. 87/01,722; 90/15,124; 92/18,588; 93/23,504; 93/23,505; and 95/34,619. Although lithium is disclosed as a possible alkali metal compound in the making of many of these formulations, potassium and especially sodium are taught as preferred metals.

U.S. Pat. No. 4,129,508 teaches an additive mixture of at least one reaction product of a hydrocarbon-substituted succinic acid or anhydride with at least one polyalkylene glycol or monoether thereof, at least one organic basic metal salt, and at least one alkoxylated amine. The basic metal can be magnesium, calcium, barium, lithium, or sodium. Example 14 shows a lithium alkyl benzene sulfonate having an apparent BN of at least 200.

There are a few patents that teach mixtures of lithium containing compounds and Group II metal-containing compounds. For example, European Patent Application No. 731,159 teaches a mixture of an overbased lithium-containing sulfonate detergent and an overbased non-lithium containing detergent. Great Britain Patent Application No. 1,365,311, in Example One, teaches a lubricating oil composition that contains both a neutral lithium salt of a polyisobutenyl succinic anhydride and an overbased sulfurized calcium phenate.

U.S. Pat. No. 5,030,687 in Example One teaches an overbased phenate/salicylate detergent (BN of at least 242) that contains a mixture of calcium and alkali metals. The alkali metal can be lithium, sodium, or potassium.

None of the prior art teaches that low BN lithium salts of substituted hydrocarbaryls give excellent black sludge dispersancy and deposit control in lubricating oil compositions.

U.S. Pat. Nos. 2,951,808; 3,351,552; 3,492,229; 3,634,240; 3,711,407; 3,985,662; 3,990,979; 4,012,330; 4,129,508; 4,176,075; 4,302,342; 4,326,972; 4,497,931; 4,797,217; 4,867,891; 4,952,328; 5,030,687; 5,464,548; 5,486,300; and 5,490,945 are hereby incorporated by reference in their entirety for all purposes.

SUMMARY OF THE INVENTION

The present invention provides an essentially sodium free, non-thixotropic oil lubricant additive that gives excellent black sludge dispersancy and deposit control in lubricating oil compositions.

The lubricant additive must be essentially free of sodium because sodium salts so are often used as leak indicators in coolants. If sodium is present in the final product, it will cause false positives in the detection of coolant leaks.

In one embodiment, the lubricant additive is also essentially free of potassium. Potassium is undesirable because potassium salts are sometimes used as leak indicators in coolants. Potassium is also undesirable because it contributes substantially to sulfated ash.

The lubricant additive comprises from 10% to 50% of a liquid organic diluent and from 30% to 90% of a substituted hydrocarbaryl metal salt, wherein at least 30 mole percent of the metal in the salt is lithium. Some of the metal can be a Group II metal, such as calcium. Preferably, at least 90 mole percent of the metal is lithium. More preferably, it is essentially free of other metals.

The substituted hydrocarbaryl metal salt can be, but is not limited to, phenates, sulfurized phenates, aromatic sulfonates, salicylates, sulfurized salicylates, salts of multi-hydroxy aromatic compounds, salts of sulfurized multi-hydroxy aromatic compounds, hydroxy aromatic sulfonates, or chemical and physical mixtures thereof, that are substituted with an alkyl or alkenyl group, preferably having from 6 to 40 carbon atoms.

The substituted hydrocarbaryl metal salt can be a neutral detergent (BN in the range of about from 0 to 30), a normal detergent (BN in the range of about from 30 to 150), a moderately overbased detergent (BN in the range of about from 150 to 225), or a high BN, overbased detergent (BN of about 225 or higher), but the BN attributable to lithium must be less than about 150.

Because of the high cost of lithium sources, it is not economical to use lithium as the primary BN source where the purpose of the BN is solely to neutralize combustion generated acids. Lithium sources are more than fifty times more expensive by weight than calcium sources. Therefore, as a practical matter, lithium would not be the only metal used in moderately overbased or high BN overbased detergents. In those applications, a Group II metal would be used as the primary BN source. Only enough lithium should be used to address performance problems, such as black sludge dispersancy and deposit control. Thus, the BN attributable to lithium would be less than 150.

In addition to the lithium, the substituted hydrocarbaryl metal salt can have a Group II metal, generally to provide additional BN. The lubricant additive can also have, in addition to the substituted hydrocarbaryl metal salt, up to 60% of a Group II metal-containing detergent to provide additional BN. Preferably, the Group II metal is selected from the group consisting of calcium, magnesium, and chemical and physical mixtures thereof. In most embodiments, the Group II metal is preferably calcium.

The Group II metal-containing detergent must be essentially free of sodium, and preferably should be essentially free of potassium. While it is possible to have lithium in the Group II metal-ontaining detergent, it would be uneconomical to do so, because of the high cost of lithium sources. The purpose of the Group II metal-containing detergent is to neutralize combustion generated acid, which would be an uneconomical use of lithium because of its high cost.

Due to the high expense of lithium sources, the use of lithium should be limited to those applications where the lithium detergent provides a needed performance benefit over other metal detergents. A low BN substituted hydrocarbaryl metal salt provides for overall formulating flexibility and higher performance impact. For any given application, the formulator needs to balance high performance, specialty components (i.e., the substituted hydrocarbaryl lithium salt) with inexpensive acid-neutralizing components. Preparing a high overbased lithium-Group II metal detergent would limit such flexibility. Therefore, it is better to formulate with a mixture of a substituted hydrocarbaryl lithium salt that is essentially free of other metals (giving a high performance impact) and a Group II metal detergent essentially free of lithium than to formulate with a single additive having low amounts of lithium and high amounts of Group II metals. If high overbased lithium-Group II metal detergents are used, the lithium should constitute at least 30% of the metal.

The performance benefits of a substituted hydrocarbaryl metal salt are not attributable to the lithium only. At least part of the benefit is derived from the substituted hydrocarbaryl moeity. Therefore, one would not get similar benefits from using an extremely small amount of a highly overbased all-lithium salt as one would obtain from using a low BN substituted hydrocarbaryl metal salt.

The Group II metal-containing detergent can be substituted hydrocarbaryl compositions, such as, but not limited to, phenates, sulfurized phenates, aromatic sulfonates, salicylates, sulfurized salicylates, multi-hydroxy aromatic compounds, sulfurized multi-hydroxy aromatic compounds, hydroxy aromatic sulfonates, or chemical and physical mixtures thereof, wherein the hydrocarbaryl groups are substituted with an alkyl or alkenyl group, preferably having from 6 to 40 carbon atoms.

The Group II metal-containing detergent can also be a salt of an alkyl or alkenyl naphthenate or a sulfurized alkyl or alkenyl naphthenate, wherein the alkyl or alkenyl group has from 4 to 40 carbon atoms. These naphthenates can include other functionalities, for example, hydroxy, carboxylic acid, sulfonic acid groups and the like and chemical and physical mixtures thereof.

The Group II metal-containing detergent can also be a salt of an alkanoic acid or a sulfurized alkanoic acid having from 10 to 50 carbon atoms, or a salt of an alkyl or alkenyl multiacid or a sulfurized alkenyl multiacid, having from 8 to 50 carbon atoms.

The Group II metal-containing detergent can also be a mixture of materials. In one embodiment, it is a mixture of a metal salt of an alkyl or alkenyl salicylate and a metal salt of a sulfurized alkyl or alkenyl phenate.

The present invention further provides lubricating oil compositions comprising a major amount of a base oil of lubricating viscosity and a minor amount of the additive of the present invention. The active ingredients can be applied at effective amounts, which are highly effective to control black sludge deposits and piston deposits.

The invention also provides a concentrate comprising these compounds, with at least one other additive, wherein the total level of organic diluent is from 20% to 80% of the total concentrate.

Both the lubricating oil composition and concentrate may also contain other additives designed to improve the properties of the base oil, including other detergent-dispersants. Examples of such additives include, but are not limited to, ashless dispersants (such as alkenylsuccinimide ashless dispersants), oxidation inhibitors, rust inhibitors, demulsifiers, extreme pressure agents (such as zinc dialkyldithiophosphate), friction modifiers, multifunctional additives, viscosity index improvers, and pour point depressants.

In one embodiment, the lubricating oil composition or concentrate contains an alkenylsuccinimide ashless dispersant and a zinc dialkyldithiophosphate.

In one embodiment, a lubricating oil composition is produced by blending a mixture of:

a major portion of a base oil of lubricating viscosity, from 1% to 25% of a lithium sulfurized alkyl or alkenyl phenate, from 1% to 25% of a calcium-containing detergent, from 0.05% to 5% of a zinc dialkyldithiophosphate, and from 1% to 25% of an alkenyl succinimide ashless dispersant.

All the components of that blend are essentially free of sodium. The lithium sulfurized alkyl or alkenyl phenate has a BN of less than 150, and is essentially free of other metals. The calcium-containing detergent can be a sulfurized alkyl or alkenyl phenate, an alkyl or alkenyl benzene sulfonate, or an alkyl or alkenyl toluene sulfonate. The alkyl or alkenyl groups of the lithium sulfurized alkyl or alkenyl phenate and the detergent have from 6 to 40 carbon atoms. The lubricating oil composition produced by that method might have a slightly different composition than the initial mixture, because the components may interact. The components can be blended in any order and can be blended as combinations of components.

Further aspects of the invention will be apparent from the following description.

DETAILED DESCRIPTION OF THE INVENTION

Prior to discussing the invention in further detail, the following terms will be defined:

Definitions

As used herein, the following terms have the following meanings, unless expressly stated to the contrary:

The term "non-thixotropic" means that the material does not have the anomalous viscosity of collodial solutions which are about to gel. This term is used to distinguish from grease thickeners, which are thixotropic and are unsuitable for use in lubricating oil compositions. The main purpose for a grease thickener is to make the grease itself.

The term "Group II metal" or "alkaline earth metal" means calcium, barium, magnesium, and strontium.

The term "metal base" refers to a metal hydroxide, metal oxide, metal alkoxide and the like and mixtures thereof, wherein the metal is selected from the group consisting of lithium, sodium, potassium, magnesium, calcium, strontium, barium, or mixtures thereof. Not all metal bases are useful in the present invention. The metal base of the present invention should be essentially free of sodium, and preferably, it should be essentially free of potassium.

The terms "essentially free of sodium" and "essentially free of potassium" mean that the only sodium and potassium present are trace impurtities. Lithium occurs naturally with small amounts of sodium and potassium, and it is impossible to obtain commercial lithium which is absolutely 100% pure. However, these small amounts of naturally occurring metals pose no problems if the contaminant is maintained below 1% in the raw material, i.e., lithium hydroxide monohydrate. In a 125 BN detergent containing 30% lithium and 70% calcium, this would translate into less than 0.005% sodium or potassium by contamination. In a 150 BN, all lithium detergent, this would translate into less than 0.015% of sodium or potassium by contamination.

The term "Base Number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

The term "the BN attributable to lithium" means the BN that comes from a lithium source.

The term "overbased detergent" refers to a composition comprising a diluent (e.g., lubricating oil) and a detergent complex wherein additional alkalinity is provided by a stoichiometric excess of a metal base, based on the amount required to react with the acidic moiety of the detergent. Enough diluent should be incorporated in the overbased detergent to ensure easy handling at safe operating temperatures.

The term "neutral detergent" refers to a detergent having a BN of up to 30.

The term "normal detergent" refers to a detergent that contains a stochiometric amount of metal base required to neutralize the acidic substituent. Such detergents can actually be basic and typically exhibit a BN of up to 150, depending upon the chemical nature of the hydrocarbaryl substituent, and are useful to neutralize engine acids.

The term "moderately overbased detergent" refers to an overbased detergent having a BN of about 150 to 225. Some moderately overbased detergents require carbonation to achieve this level of BN.

The term "high BN, overbased detergent" refers to an overbased detergent having a BN of from 225 to 350, or more. Generally a carbon dioxide treatment is required to obtain high BN overbased detergent compositions. For sulfonates, salicylates, etc., it is believed that this forms a colloidal dispersion of metal base.

The term "alkanoic acid" refers to carboxylic acids of the type R—COOH, where R is an alkyl group.

The term "lower alkanoic acid" refers to alkanoic acids having one through three carbon atoms, i.e., formic acid, acetic acid, and propionic acid, and mixtures thereof.

The term "alkyl or alkenyl multiacid" refers to a compound containing two or more carboxylic groups, such as $R(COOH)_2$, where R is an alkyl or alkenyl group.

The term "hydrocarbaryl" means an aryl that is substituted with an alkyl or alkenyl group.

The term "substituted hydrocarbaryl" means a hydrocarbaryl wherein the aryl is substituted with some other functionality that is capable of forming a metal salt, for example, hydroxy, carboxylic acid, sulfonic acid groups and the like and chemical and physical mixtures thereof, in addition to the alkyl or alkenyl group.

The term "substituted hydrocarbaryl metal salt" means a metal salt of a substituted hydrocarbaryl. In other words, it is a metal salt of an aryl that is substituted with an alkyl or alkenyl group and is substituted with some other functionality that is capable of forming a metal salt.

Unless otherwise specified, all percentages are in weight percent.

Non-Thixotropic Lubricant Additive

The present invention provides a non-thixotropic essentially sodium free lubricant additive. Preferably, the additive is also essentially free of potassium. That lubricant additive has from 10% to 50% of a liquid organic diluent and from 30% to 90% of a substituted hydrocarbaryl metal salt, wherein at least 30 mole percent of the metal is lithium. In addition, the non-hixotropic lubricant additive may have up to 60% of a Group II metal-containing detergent to provide additional BN.

The lubricant additive can have a BN of from 0 to 350 or more, in which the BN attributable to lithium is less than 150. The remaining BN can be provided by Group II metal present in the substituted hydrocarbaryl metal salt and/or by the Group II metal-containing detergent.

Suitable liquid organic diluents include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 1000° F. (380° C.), although an oil of lubricating viscosity may be used.

A lubricant additive should be non-thixotropic in order to make handling easier and because additives that are too viscous at room temperature generally make final products that are too viscous to be commercially viable. We have found that we can produce a non-thixotropic lubricant additive if we use enough liquid organic diluent and if enough of the metal in our substituted hydrocarbaryl metal salt is lithium instead of other metals.

The lubricant additive should be essentially free of sodium because the presence of sodium in a final product gives false positives in the detection of coolant leaks. Sodium salts are often used as leak indicators in coolants.

Preferably, the lubricant additive should be essentially free of potassium because potassium salts are sometimes used as leak indicators in coolants and because potassium contributes substantially to sulfated ash.

Substituted Hydrocarbaryl Metal Salt

At least 30 mole percent of the metal in the substituted hydrocarbaryl metal salt is lithium, but the salt can contain at least one Group II metal, such as calcium. Preferably, at least 90 mole percent of the metal is lithium. More preferably, essentially all of the metal is lithium. The reasons for this perference for the metal being predominately lithium has been discussed above: overall formulating flexibility and higher performance impact.

As stated above, a substituted hydrocarbaryl metal salt is a metal salt of an aryl that is substituted with both (a) an alkyl or alkenyl group and (b) some other functionality which is capable of forming a metal salt. The alkyl or alkenyl group has from 6 to 40 carbon atoms. The aryl part of the hydrocarbaryl group (in other words, the aromatic moeity) can be benzene, toluene, xylene, or mixtures thereof. Preferably, the aromatic moeity of the hydrocarbaryl group is benzene or toluene. This aromatic moeity is substituted with both (a) an alkyl or alkenyl group and (b) some other functionality which is capable of forming a metal salt.

Examples of substituted hydrocarbaryl metal salts useful in the present invention are, but are not limited to, the following:

(a) alkyl or alkenyl phenates;

(b) alkyl or alkenyl sulfurized phenates;

(c) alkyl or alkenyl aromatic sulfonates;

(d) alkyl or alkenyl salicylates;

(e) alkyl or alkenyl sulfurized salicylates;

(f) salts of alkyl or alkenyl multi-hydroxy aromatic compound;

(g) salts of alkyl or alkenyl sulfurized multi-hydroxy aromatic compound;

(h) alkyl or alkenyl hydroxy aromatic sulfonates; or (i) chemical and physical mixtures thereof.

While the above list is extensive, it is not meant to be exclusive. Other substituted hydrocarbaryl compositions can be used, including hybrids of the above.

The preparation of these hydrocarbaryl compositions, using salts other than lithium, is described in the patents discussed below. The present invention differs from these patents in that at least 30 mole percent of the metal in our salt is lithium and is essentially free of sodium. The remainder of the metal can be Group II metal, such as calcium and magnesium. Preferably, at least 90 mole percent of the metal is lithium. More preferably all of the metal is lithium, for the practical reasons given above.

Substituted Phenates and Substituted Sulfurized Phenates

In one embodiment, the substituted hydrocarbaryl metal salt is an alkyl or alkenyl phenate or a sulfurized alkyl or alkenyl phenate. Such a substituted hydrocarbaryl metal salt would be at least partly basic (BN of at least 30).

The preparation of overbased phenates, in general, is described, for example, in U.S. Pat. Nos. 2,680,096; 3,178,368; 3,367,867; 3,801,507; and the like. The disclosures of each are incorporated herein by reference in their entirety for all purposes. Typically, overbased phenates have been prepared by combining, under elevated temperatures, an alkylphenol, a neutral or overbased hydrocarbyl or hydrocarbaryl sulfonate, a high molecular weight alcohol, lubricating oil, a Group II metal oxide, hydroxide or $C_1$ to $C_6$ alkoxide, sulfur, and a polyol promoter, typically an alkylene glycol, to the heated mixture. The water of reaction is removed and carbon dioxide added. Uncombined carbon dioxide is removed and the reaction vessel is then further heated under vacuum to remove the alkylene glycol, water, and the high molecular weight alcohol. The product is overbased by incorporation therein of hydrated lime and carbon dioxide. Typically an alkylene glycol is used to promote both the neutralization and sulfurization, and also to facilitate overbasing.

However, a problem is encountered when the alkylene glycol or other polyol promoter is employed in the presence of significant amounts of sulfur. Specifically, under such reaction conditions, the alkylene glycol or other polyol promoter is oxidized (for example, ethylene glycol is oxidized to the calcium salt of oxalic acid) while the sulfur is reduced to hydrogen sulfide. Such oxidation products are known to be detrimental to engine life.

In our U.S. Ser. No. 08/644,995, filed Mar. 14, 1996, entitled "Methods for Preparing Normal and Overbased Phenates," we disclosed that sulfurized alkylphenates can be advantageously prepared without the use of a polyol or alkanol sulfurization promoter by conducting the sulfurization neutralization in the presence of a lower molecular weight alkanoic acid, i.e., formic acid, acetic acid, or propionic acid, or a mixture of lower alkanoic acids.

That process can be conveniently conducted by contacting the desired alkylphenol with sulfur in the presence of a lower alkanoic acid and metal base (at least 30 mole percent of the metal being lithium) under reactive conditions, preferably in an inert-compatible liquid hydrocarbon diluent. Preferably the reaction is conducted under an inert gas, typically nitrogen. In theory the neutralization can be conducted as a separate step prior to sulfurization, but pragmatically it is generally more convenient to conduct the sulfurization and the neutralization together in a single process step. Also, in place of the lower alkanoic acid, salts of the alkanoic acids or mixtures of the acids and salts could also be used. In general, the acids are preferred and accordingly the process will be described below with respect to the use of lower alkanoic acid; however, it should be appreciated that the teachings are also applicable to the use of salts and mixtures of salts in place of all or a portion of the acids.

The combined neutralization and sulfurization reaction is typically conducted at temperatures in the range of about from 115° to 300° C., preferably 135° to 250° C., most preferably 190° to 230° C., depending on the particular metal and alkanoic acid used. Where formic acid is used alone, we have found that best results are generally obtained by using temperatures in the range of about from 150° to 200° C. By using formic acid with other alkanoic acids (acetic, propionic, or acetic/propionic), one can advantageously use the higher reaction temperatures and obtain higher base retention and reduced piston deposits. For example, with these mixtures, one can use temperatures in the range of about from 180° to 250° C. and especially at temperatures of about from 190° to 230° C.

Mixtures of two or all three of the lower alkanoic acids also can be used. Mixtures containing about from 5% to 25% formic acid and about from 75% to 95% acetic acid are especially advantageous where normal or moderately overbased products are desired. Based on one mole of alkylphenol, typically from 0.8 to 3.5, preferably from 1.2 to 2, moles of sulfur and about 0.025 to 2, preferably 0.1 to 0.8, moles of lower alkanoic acid are used.

Typically about 0.3 to 1.3 mole, preferably 0.5 to 1.0 mole, of metal base are employed per mole of alkylphenol. In addition an amount of metal base sufficient to neutralize the lower alkanoic acid is also used. Thus overall, typically about from 0.3 to 2 moles of metal base are used per mole of alkylphenol, including the base required to neutralize the lower alkanoic acid. If preferred, lower alkanoic acid to alkylphenol and metal base to alkylphenol ratios are used, then the total metal base to alkylphenol ratio range will be about from 0.55 to 1.2 moles of metal base per mole of alkylphenol. Obviously, this additional metal base will not be required where salts of alkanoic acids are used in place of the acids.

The reaction is also typically and preferably conducted in a compatible liquid diluent, preferably a low viscosity mineral or synthetic oil. The reaction is preferably conducted for a sufficient length of time and at a sufficient temperature to ensure complete reaction of the sulfur. This is especially important where high BN products are desired because the synthesis of such products generally requires using carbon dioxide together with a polyol promoter. Accordingly, any unreacted sulfur remaining in the reaction mixture will catalyze the formation of deleterious oxidation products of the polyol promoter during the overbasing step.

Where the neutralization is conducted as a separate step, both the neutralization and the subsequent sulfurization are conducted under the same conditions as set forth above. Optionally specialized sulfurization catalysts, such as described in U.S. Pat. No. 4,744,921, the disclosure of which is hereby incorporated by reference in its entirety for all purposes, can be employed in the neutralization-sulfurization reaction together with the lower alkanoic acid. But, in general any benefit afforded by the sulfurization catalyst, for example, reduced reaction time, is offset by the increase in costs incurred by the catalyst and/or the presence of undesired residues in the case of halide catalysts or alkali metal sulfides; especially, as excellent reaction rates can be obtained by merely using acetic and/or propionic acid mixtures with formic acid and increasing reaction temperatures.

In one embodiment, the sulfurization process is conducted in the presence of water throughout the process. This results in lower crude sediments (more efficient filtration), less haze, and improved water stability.

Preferably, at least 50% of the promoter is added to the reaction at a temperature of at least 130° C. This results in more efficient filtration.

Optionally, an alkenyl succinimide or a neutral or overbased Group II metal hydrocarbylsulfonate is added to either the neutralization-sulfurization reaction mixture or overbasing reaction mixture. The succinimide or sulfonate assists in solubilizing both the alkylphenol and the phenate reaction product and therefore, when used, is preferably added to the initial reaction mixture.

Typically, the process is conducted under vacuum up to a slight pressure, i.e., pressures ranging from about 25 mm Hg absolute to 850 mm Hg absolute and preferably is conducted under vacuum to reduce foaming up to atmospheric pressure, e.g., about from 40 mm Hg absolute to 760 mm Hg absolute.

Additional details regarding the general preparation of sulfurized phenates can be had by reference to the various publications and patents in this technology such as, for example, U.S. Pat. Nos. 2,680,096; 3,178,368 and 3,801,507. In general, all allotropic forms of sulfur can be used. The sulfur can be employed either as molten sulfur or as a solid (e.g., powder or particulate) or as a solid suspension in a compatible hydrocarbon liquid.

In one embodiment, the metal base used is lithium hydroxide because it affords excellent results. Other lithium bases can also be used, for example, lithium alkoxides.

Suitable alkylphenols which can be used in this invention are those wherein the alkyl substituents contain a sufficient number of carbon atoms to render the resulting overbased sulfurized alkylphenate composition oil-soluble. Generally, $C_{12}$ propylene tetramer alkyl substituents are satisfactory. However, if needed, greater oil solubility may be provided by a single long chain alkyl substituent or by a combination of alkyl substituents, e.g., $C_{20-24}$.

Preferably, the alkylphenols are para-alkylphenols or ortho-alkylphenols. Since it is believed that para alkylphenols facilitate the preparation of sulfurized alkylphenate, the alkylphenol is preferably predominantly a para-alkylphenol with no more than about 45 mole percent of the alkylphenol being ortho-alkylphenols; and more preferably no more than about 35 mole percent of the alkylphenol is ortho-alkylphenol. Alkyl-hydroxy toluenes or xylenes, and other alkyl phenols having one or more alkyl substituents in addition to at least one long chained alkyl substituent can also be used.

In general the present process introduces no new factor or criteria for the selection of alkylphenols and accordingly the selection of alkylphenols can be based on the properties desired for lubricating oil compositions, notably BN and oil solubility, and the criteria used in the prior art or similar sulfurization overbasing process and/or processes. For example, in the case of alkylphenate having substantially straight chain alkyl substituents, the viscosity of the alkylphenate composition can be influenced by the position of an attachment on the alkyl chain to the phenyl ring, e.g., end attachment versus middle attachment. Additional information regarding this and the selection and preparation of suitable alkylphenols can be had for example from U.S. Pat. Nos. 5,024,773, 5,320,763; 5,318,710; and 5,320,762, all of which are hereby incorporated by reference in their entirety for all purposes.

If a supplemental sulfurization catalyst, such as for example desired in U.S. Pat. No. 4,744,921, is employed, it is typically employed at from about 0.5% to 10% relative to the alkylphenol, and preferably at from about 1% to 2%. In a preferred embodiment, the sulfurization catalyst is added to the reaction mixture as a liquid. This can be accomplished by dissolving the sulfurization catalyst in molten sulfur or in the alkylphenol as a premix to the reaction.

It is generally advantageous to use a small amount of an inert hydrocarbon diluent in the process to facilitate mixing and handling of the reaction mixture and product. Typically, a mineral oil will be used for this purpose because of its obvious compatibility with the use of the product in lubricating oil combinations. Suitable lubricating oil diluents which can be used include for example, solvent refined 100N, i.e., Cit-Con 100N, and hydrotreated 100N, i.e., RLOP 100N, and the like. The inert hydrocarbon diluent preferably has a viscosity of from about 1 to about 20 cSt at 100° C.

Substituted Aromatic Sulfonates

In another embodiment, the substituted hydrocarbaryl metal salt is an alkyl or alkenyl aromatic sulfonate. Preferably, it is an alkyl or alkenyl benzene sulfonate or an alkyl or alkenyl toluene sulfonate.

The preparation of overbased aromatic sulfonates is well known in the art and is described, for example, in U.S. Pat. No. 4,797,217, hereby incorporated by reference in its entirety for all purposes. That patent teaches a process for making overbased lithium sulfonates (BN of at least 250) using lithium hydroxide monohydrate.

For the reasons given above, the present invention would not use lithium to provide such high BN. Therefore, the process taught by U.S. Pat. No. 4,797,217 is modified to allow the use of less base. Since the production of a lower overbased product is usually easier that that of a higher overbased product, this modification is well within the scope of one having ordinary skill in the art.

Substituted Salicylates

In another embodiment, the substituted hydrocarbaryl metal salt is an alkyl or alkenyl salicylate or a sulfurized alkyl or alkenyl salicylate. Such a substituted hydrocarbaryl group would be at least partly basic (BN of at least 30).

The preparation of salicylates or sulfurized salicylates, in general, is described, for example, in U.S. Pat. Nos. 2,197,832; 5,538,650; and the like. The disclosures of each of those patents are incorporated herein by reference in their entirety for all purposes.

U.S. Pat. No. 5,538,650 discloses the preparation of a sulphurised salicylate by reacting a phenol and a diol with alkaline earth oxide and/or hydroxide plus water (metal reagent) in a metal addition step; distilling off water and diol; reacting the bottoms with carbon dioxide; and reacting with diol and sulphur to produce final product.

The process disclosed by U.S. Pat. No. 5,538,650 could be modified to prepare the substituted hydrocarbaryl metal salt of the present invention by replacing the said diol in the final step with lower alkanoic acid type promoter and by substituting the alkaline earth oxide and/or hydroxide with an appropriate amount of lithium oxide and/or hydroxide.

Salts of Substituted Multi-Hydroxy Aromatic Compounds

In another embodiment, the substituted hydrocarbaryl metal salt is a metal salt of a multi-hydroxy alkyl or alkenyl aromatic compound or a sulfurized multi-hydroxy alkyl or alkenyl aromatic compound. Preferably, it is a salt of a multi-hydroxy alkyl or alkenyl benzene or a salt of a multi-hydroxy alkyl or alkenyl toluene.

The preparation of multi-hydroxy substituted aromatic compounds, in general, is described, for example, in U.S. Pat. No. 5,160,650, and the like. The disclosure of U.S. Pat. No. 5,160,650 is incorporated herein by reference in its entirety for all purposes.

Example 18 of U.S. Pat. No. 5,160,650 discloses the alkylation of a catechol with alpha-olefins.

Substituted Hydroxy Aromatic Sulfonates

In another embodiment, the substituted hydrocarbaryl metal salt is an alkyl or alkenyl hydroxy aromatic sulfonate. Preferably, it is an alkyl or alkenyl hydroxy benzene sulfonate or an alkyl or alkenyl hydroxy toluene sulfonate.

The preparation of substituted hydroxy aromatic sulfonates, in general, is described, for example, in U.S. Pat. Nos. 3,523,898; 4,751,010; 5,330,663; 5,330,664; and the like. The disclosures of each are incorporated herein by reference in their entirety for all purposes.

U.S. Pat. No. 3,523,898 teaches that overbased alkyl phenol sulfonic acids (BN of 150 or less) are useful as detergents in lubricating oils. U.S. Pat. No. 4,751,010 teaches that partial sulfonation of alkylphenol results in the formation of an alkyl hydroxy benzene sulfonate that can be overbased using sulfurization and carbonation (BN of from 200 to 250). U.S. Pat. Nos. 5,330,663 and 5,330,664 teach neutral and low overbased alkylphenoxy sulfonates that have alkyl groups derived from internal olefins.

The processes disclosed by those patents can be readily modified to produce the lithium salts used in the present invention by using lithium sources as the metal base.

Group II Metal-Containing Detergent

In addition to the base oil of lubricating viscosity and the substituted hydrocarbaryl metal salt, the lubricant additive can have a Group II metal-containing detergent. Preferably, the Group II metal is selected from the group consisting of calcium, magnesium, and mixtures thereof, such as naturally occuring dolomite. More preferably, it is calcium, or in some applications magnesium. The general preparation of such detergents has already been described above.

The Group II metal-containing detergent can be substituted hydrocarbaryl compositions, such as, but not limited to, phenates, sulfurized phenates, aromatic sulfonates, salicylates, sulfurized salicylates, multi-hydroxy aromatic compounds, sulfurized multi-hydroxy aromatic compounds, hydroxy aromatic sulfonates, or chemical and physical mixtures thereof, wherein the substituted hydrocarbaryl groups have an alkyl or alkenyl group, preferably having from 6 to 40 carbon atoms. Preferably, the aromatic moeity of the hydrocarbaryl group is benzene or toluene.

The Group II metal-containing detergent can also be a salt of an alkyl or alkenyl naphthenate or a sulfurized alkyl or alkenyl naphthenate, wherein the alkyl or alkenyl group has from 4 to 40 carbon atoms. It can also be a salt of an alkanoic acid or a sulfurized alkanoic acid having from 10 to 50 carbon atoms (preferably, oleic acid, steric acid, palmatic acid, or tall acid), or a salt of alkyl or alkenyl multiacid or a sulfurized alkenyl mufiacid, having from 8 to 50 carbon atoms (preferably sebacic acid or suberic acid).

In one embodiment, the Group II metal detergent is a mixture of a metal salt of an alkyl or alkenyl salicylate and a metal salt of a sulfurized alkyl or alkenyl phenate.

Other Additive Components

The following additive components are examples of components that can be favorably employed in combination with the substituted hydrocarbaryl metal salt in the compositions of the present invention:

(1) Ashless dispersants: alkenyl succinimides, alkenyl succinimides modified with other organic compounds, and alkenyl succinimides modified with boric acid, alkenyl succinic ester.

(2) Oxidation inhibitors

1) Phenol type phenolic) oxidation inhibitors: 4,4'-methylenebis (2,6-di-tert-butylphenol), 4,4'-bis(2,6di-tert-butylphenol), 4,4'-bis(2-methyl-6-tert-butylphenol), 2,2'-(methylenebis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-α-dimethylamino-p-cresol, 2,6-di-tert-4-(N.N'dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl-4-hydroxybenzyl).

2) Diphenylamine type oxidation inhibitor: alkylated diphenylamine, phenyl-α-naphthylamine, and alkylated α-naphthylamine.

3) Other types: metal dithiocarbamate (e.g., zinc dithiocarbamate), and methylenebis (dibutyldithiocarbamate).

(3) Rust inhibitors (Anti-rust agents)

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

2) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(4) Demulsifiers: addition product of alkylphenol and ethyleneoxide, poloxyethylene alkyl ether, and polyoxyethylene sorbitane ester.

(5) Extreme pressure agents (EP agents): zinc dialkyldithiophosphate (Zn—DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

(6) Friction modifiers: fatty alcohol, fatty acid, amine, borated ester, and other esters (7) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenym complex compound (8) Viscosity index improvers: polymethacrylate type polymers, ethylene-propylene copolymers, styrene-isoprene copolymers, hydrated styrene-isoprene copolymers, polyisobutylene, and dispersant type viscosity index improvers.

(9) Pour point depressants: polymethyl methacrylate.

(10) Foam Inhibitors: alkyl methacrylate polymers and dimethyl silicone polymers.

Lubricating Oil Compositions

The additives produced by the process of this invention are useful for imparting detergency and dispersancy properties to the lubricating oil. When employed in this manner, the amount of the substituted hydrocarbaryl metal salt ranges from about 0.5% to 40% of the total lubricant composition, although preferably from about 1% to 25% of the total lubricant composition. Such lubricating oil compositions are useful in the crankcase of an internal combustion engine, such as gasoline engines and diesel engines, including passenger car, heavy duty on-road and off-road, railroad, natural gas and marine, such as trunk piston and slow speed crosshead. They are also useful in hydraulic applications. As noted above, such compositions are frequently used in combination with Group II metal detergents.

The lubricating oil composition can be used in a method of decreasing black sludge deposits, a method of decreasing piston deposits, or both.

Such lubricating oil compositions employ a finished lubricating oil, which may be single or multigrade. Multigrade lubricating oils are prepared by adding viscosity index (VI) improvers. Typical VI improvers are polyalkyl methacrylates, ethylene-propylene copolymers, styrene-diene copolymers, and the like. So-called dispersant VI improvers, which exhibit dispersant properties as well as VI modifying properties, can also be used in such formulations.

Oil of Lubricating Viscosity

The oil of lubricating viscosity used in such compositions may be mineral oil or synthetic oils of viscosity suitable for use in the crankcase of an internal combustion engine, such as gasoline engines and diesel engines, including passenger car, heavy duty on-road and off-road, railroad, natural gas and marine, such as trunk piston and slow speed crosshead. Crankcase lubricating oils ordinarily have a viscosity of about 1300 cSt 0° F. to 24 cSt at 210° F. (99° C). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of both monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acids and mono and dihydroxy alkanols can also be used.

Blends of mineral oils with synthetic oils are also useful. For example, blends of 10% to 25% hydrogenated 1-trimer with 75% to 90% 150 SUS (100° F.) mineral oil gives an excellent lubricating oil base.

In one embodiment, a lubricating oil composition would contain (a) a major amount of an oil of lubricating viscosity;

(b) from 1% to 20% of at least one ashless dispersant;

(c) from 1% to 40% of the non-thixotropic lubricant additive of the present invention;

(d) from 0.05% to 5% of at least one zinc dithiophosphate;

(e) from 0.0% to 10% of at least one oxidation inhibitor;

(f) from 0.0% to 1% of at least one foam inhibitor; and (g) from 0.0% to 20% of at least one viscosity index improver.

Additive Concentrates

Additive concentrates are also included within the scope of this invention. The concentrates of this invention comprise the compounds or compound mixtures of the present invention, with at least one other additive. Typically, the concentrates contain sufficient organic diluent to make them easy to handle during shipping and storage. The total level of organic diluent in the concentrate must be from 20% to 80% of the total concentrate. Organic diluents have been described above.

In one embodiment, the conconcentrate has an alkenyl succinimide ashless dispersant and a zinc dialkyldithiophosphate, in addition to other components.

Examples of Additive Packages

Below are representative examples of additive packages that can be used in a variety of applications. These representative examples employ the non- thixotropic lubricant additive used in the present invention. That non-thixotropic lithiumcontaining lubricant additive may be either with or without the Group II metal-containing detergent, depending upon the desired BN of the final product. The following weight percents are based on the amount of active component, with neither process oil nor diluent oil, but including sufficent Group II metal-containing detergent to achieve the desired BN. These examples are provided to illustrate the present invention, but they are not intended to limit it.

| | | |
|---|---|---|
| I. Marine Diesel Engine Oils | | |
| 1) | Non-thixotropic lubricant additive | 65% |
| | Primary alkyl Zn-DTP | 5% |
| | Oil of lubricating viscosity | 30% |
| 2) | Non-thixotropic lubricant additive | 65% |
| | Alkenyl succinimide ashless dispersant | 5% |
| | Oil of lubricating viscosity | 30% |
| 3) | Non-thixotropic lubricant additive | 60% |
| | Primary alkyl Zn-DTP | 5% |
| | Alkenyl succinimide ashless dispersant | 5% |
| | Oil of lubricating viscosity | 30% |
| 4) | Non-thixotropic lubricant additive | 65% |
| | Phenol type oxidation inhibitor | 10% |
| | Oil of lubricating viscosity | 25% |
| 5) | Non-thixotropic lubricant additive | 55% |
| | Alkylated diphenylamine-type oxidation inhibitor | 15% |
| | Oil of lubricating viscosity | 30% |
| 6) | Non-thixotropic lubricant additive | 65% |
| | Phenol-type oxidation inhibitor | 5% |
| | Alkylated diphenylamine-type oxidation inhibitor | 5% |
| | Oil of lubricating viscosity | 25% |
| 7) | Non-thixotropic lubricant additive | 60% |
| | Primary alkyl Zn-DTP | 5% |
| | Phenol-type oxidation inhibitor | 5% |
| | Oil of lubricating viscosity | 30% |

-continued

| | | |
|---|---|---|
| 8) | Non-thixotropic lubricant additive | 60% |
| | Alkenyl succinimide ashless dispersant | 5% |
| | Alkylated diphenylamine-type oxidation inhibitor | 10% |
| | Oil of lubricating viscosity | 25% |
| 9) | Non-thixotropic lubricant additive | 55% |
| | Other additives | 25% |
| | Primary alkyl Zn-DTP | |
| | Alkenyl succinic ester ashless dispersant | |
| | Phenol-type oxidation inhibitor | |
| | Alkylated diphenylamine-type oxidation inhibitor | |
| | Oil of lubricating viscosity | 30% |
| II. Motor Car Engine Oils | | |
| 1) | Non-thixotropic lubricant additive | 25% |
| | Alkenyl succinimide ashless dispersant | 35% |
| | Primary alkyl Zn-DTP | 10% |
| | Oil of lubricating viscosity | 30% |
| 2) | Non-thixotropic lubricant additive | 20% |
| | Alkenyl succinimide ashless dispersant | 40% |
| | Secondary alkyl Zn-DTP | 5% |
| | Dithiocarbamate type oxidation inhibitor | 5% |
| | Oil of lubricating viscosity | 30% |
| 3) | Non-thixotropic lubricant additive | 20% |
| | Alkenyl succinimide ashless dispersant | 35% |
| | Secondary alkyl Zn-DTP | 5% |
| | Phenol type oxidation inhibitor | 5% |
| | Oil of lubricating viscosity | 35% |
| 4) | Non-thixotropic lubricant additive | 20% |
| | Alkenyl succinimide ashless dispersant | 30% |
| | Secondary alkyl Zn-DTP | 5% |
| | Dithiocarbamate type anti-wear agent | 5% |
| | Oil of lubricating viscosity | 40% |
| 5) | Non-thixotropic lubricant additive | 20% |
| | Succinimide ashless dispersant | 30% |
| | Secondary alkyl Zn-DTP | 5% |
| | Molybdenum-containing anti-wear agent | 5% |
| | Oil of lubricating viscosity | 40% |
| 6) | Non-thixotropic lubricant additive | 20% |
| | Alkenyl succinimide ashless dispersant | 30% |
| | Other additives | 10% |
| | Primary alkyl Zn-DTP | |
| | Secondary alkyl Zn-DTP | |
| | Alkylated diphenylamine-type oxidation inhibitor | |
| | Dithiocarbamate type anti-wear agent | |
| | Oil of lubricating viscosity | 40% |
| 7) | Non-thixotropic lubricant additive | 60% |
| | Other additives | 10% |
| | Phenol type oxidation inhibitor | |
| | Alkylated diphenylamine-type oxidation inhibitor | |
| | Dithiocarbamate type anti-wear agent | |
| | Demulsifier | |
| | Boron-containing friction modifier | |
| | Oil of lubricating viscosity | 30% |
| III. Hydraulic Oils | | |
| 1) | Non-thixotropic lubricant additive | 20% |
| | Primary alkyl Zn-DTP | 50% |
| | Other additives | 25% |
| | Phenol type oxidation inhibitor | |
| | Phosphorous-containing extreme pressure agent | |
| | Triazol type corrosion inhibitor | |
| | Demulsifier | |
| | Nonionic anti-rust agent | |
| | Oil of lubricating viscosity | 5% |
| 2) | Non-thixotropic lubricant additive | 10% |
| | Primary alkyl Zn-DTP | 40% |
| | Other additives | 47% |
| | Phenol type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 3% |
| 3) | Non-thixotropic lubricant additive | 10% |
| | Phosphorous-containing extreme pressure agent | 40% |

-continued

| | | |
|---|---|---|
| | Phenol type oxidation inhibitor | 15% |
| | Other additives | 25% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 10% |
| 4) | Non-thixotropic lubricant additive | 20% |
| | Phosphorous-containing extreme pressure agent | 30% |
| | Other additives | 45% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | |
| IV. | Transmission Hydraulic Fluids | |
| 1) | Non-thixotropic lubricant additive | 35% |
| | Primary alkyl Zn-DTP | 20% |
| | Polyol type friction modifier | 20% |
| | Sulfur-containing extreme pressure agent | 5% |
| | Oil of lubricating viscosity | 20% |
| 2) | Non-thixotropic lubricant additive | 40% |
| | Primary alkyl Zn-DTP | 15% |
| | Amide type friction modifier | 15% |
| | Sulfur-containing extreme pressure agent | 5% |
| | Oil of lubricating viscosity | 25% |
| 3) | Non-thixotropic lubricant additive | 30% |
| | Primary alkyl Zn-DTP | 20% |
| | Other additives | 30% |
| | Alkenyl succinimide ashless dispersant | |
| | Amide type friction modifier | |
| | Ester type friction modifier | |
| | Phosphorous, Sulfur-containing extreme pressure agent | |
| | Oil of lubricating viscosity | 20% |
| 4) | Non-thixotropic lubricant additive | 35% |
| | Primary alkyl Zn-DTP | 15% |
| | Other additives | 25% |
| | Polyol type friction modifier | |
| | Amide type friction modifier | |
| | Phosphorous, Sulfur-containing extreme pressure agent | |
| | Oil of lubricating viscosity | 25% |

Process for Producing a Lubricating Oil Composition

In one embodiment, a lubricating oil composition is produced by blending a mixture of:

(a) a major portion of an oil of lubricating viscosity, (b) from 1% to 25% of a lithium sulfurized alkyl or alkenyl phenate, (c) from 1% to 25% of a calcium-containing detergent, (d) from 0.05% to 5% of a zinc dialkyldithiophosphate, and (e) from 1% to 25% of an alkenyl succinimide ashless dispersant.

All the components of that blend are all essentially free of sodium, and the BN attributable to the lithium less than 150.

The lithium sulfurized alkyl or alkenyl phenate is essentially free of other metals. The alkyl or alkenyl group of the phenate has from 6 to 40 carbon atoms.

The calcium-containing detergent is preferably a sulfurized alkyl or alkenyl phenate, an alkyl or alkenyl benzene sulfonate, an alkyl or alkenyl toluene sulfonate, an alkyl or alkenyl salicylate, or chemical and physical mixtures thereof. The alkyl or alkenyl group of that detergent has from 6 to 40 carbon atoms. Preferably, at least 75 mole percent of the metal in the detergent is calcium.

The lubricating oil composition produced by that method might have a slightly different composition than the initial mixture, because the components may interact. The components can be blended in any order and can be blended as combinations of components.

EXAMPLES

The invention will be further illustrated by following examples, which set forth particularly advantageous method embodiments. While the Examples are provided to illustrate the present invention, they are not intended to limit it.

EXAMPLES OF PREPARATION OF LITHIUM SUBSTITUTED HYDROCARBARYL METAL SALTS

Example 1:125 BN Litium Phenate

One mole of $C_{12}$ branched alkyl phenol is charged to a two liter, three-necked round bottom flask fitted with heating mantle, an overhead stirrer, a still head, condenser and collector. 500 mLs of xylene, and 150 mLs of 100 N diluent oil are charged to the reactor. While stirring at 400 rpm, 0.2 mole of $LiOH.H_2O$ is added at room temperature, then the mixture is heated over one hour to reflux, and maintained at this temperature until water evolution stops. Vacuum is adjusted slowly to 0.5 psia so as to avoid bumping. Distilling continues until all evolution of xylene stops and some diluent oil begins collecting on the condenser. The product is cooled and filtered to afford a bright oil which is diluted with 100 N diluent oil to 125 BN so that it flowable at safe operating temperatures.

Example 2:125 BN Lithium Sulfurized Phenate

A four liter vessel with overhead stirrer, vacuum and nitrogen flow was charged with 1500 grams (5.7 mole) of $C_{12}$ branched alkyl phenol, 900 grams of 100 N diluent oil, 250 grams (5.95 mole) of $LiOH.H_2O$, 276 grams (8.63 moles) of solid sulfur and 47 grams of 10% formic/90% acetic acid. The reaction mixture was heated to 205° C. at 14.2 psia over two and a half hours and held at this temperature for two hours. The temperature then was ramped to 210° C. in ten minutes, the vacuum was adjusted to one psia, and the reaction mixture was distilled for one half hour at 210° C. The concentrate was cooled to 180° C., filtered over diatomaceous earth, and diluted to 125 BN with diluent oil.

Example 3:125 BN Aromatic Sulronate

To a two liter, 4-necked round bottom flask is added 100 grams methanol, 480 grams xylene, and 75 grams (1.75 moles) $LiOH.H_2O$. The resulting mixture is stirred for ten minutes. Afterwards, 210 grams (0.45 moles) of $C_{20-24}$ alkyl benzene sulfonic acid is slowly added to the system over about a 1.5 hour period, while maintaining a maximum temperature of 31° C.

At this point, carbonation is initiated and approximately 28 grams (0.65 moles) of carbon dioxide is added over about three hours. Upon completion of the carbonation step, the system is heated to 93° C. over a two hour period and then heated to 132° C. over thirty minutes. At this point, 155 grams of diluent oil is added and the system heated to 204° C. over 1.5 hours under vacuum to remove xylene. The resulting solution is filtered over diatomaceous earth and diluted to 125 BN with diluent oil so that it flowable at safe operating temperatures.

Example 4:125 BN Salicylate 400 grams (one mole) of $C_{22}$ alkyl phenol is charged to a two liter, three-necked round bottom flask fitted with heating mantle, an overhead stirrer, a still head, condenser and collector. 500 mLs of xylene, and 150 mLs of 100 N diluent oil are charged to the round bottom flask. While stirring at 400 rpm, 42 grams (one mole) of $LiOH.H_2O$ is added at room temperature, then the mixture is heated over one hour to reflux, and maintained at this temperature until water evolution stops. Vacuum is adjusted slowly to 0.5 psia so as to avoid bumping. Distilling continues until all evolution of xylene stops, and some diluent oil begins collecting.

The mixture is next carboxylated at 150° C. and 14 bar of carbon dioxide pressure. The concentrate is cooled, filtered over diatomaceous earth, and diluted to 125 BN with diluent oil.

Example 5:125 BN Sulfurized Salicylate 400 grams (one mole) of $C_{22}$ alkyl phenol is charged to a two liter, three-necked round bottom flask fitted with heating mantle, an overhead stirrer, a still head, condenser and collector. 500 mLs of xylene, and 150 mLs of 100 N diluent oil are charged to the round bottom flask. While stirring at 400 rpm, 42 grams (one mole) of $LiOH.H_2O$ is added at room temperature, then the mixture is heated over one hour to reflux, and maintained at this temperature until water evolution stops. Vacuum is adjusted slowly to 0.5 psia so as to avoid bumping. Distilling continues until all evolution of xylene stops, and some diluent oil begins collecting.

The mixture is next cooled to 90° C., and charged with 20 grams (0.62 mole) sulfur, and 8 grams of 10% formic/90% acetic acid. The reaction mixture is heated to 200° C. at 14.2 psia over three hours and held at this temperature for three hours. The vacuum is adjusted to one psia, and the reaction mixture distilled for 0.5 hour.

The mixture is next carboxylated at 150° C. and 14 bar of carbon dioxide pressure. The concentrate is cooled, filtered over diatomaceous earth, and diluted to 125 BN with diluent oil.

Example 5:25 BN Multi-Hydroxy Aromatic Compound

A one mole of $C_{12}$ branched alkyl catechol is charged to a two liter, three-necked round bottom flask fitted with heating mantle, an overhead stirrer, a still head, condenser and collector. 500 mLs of xylene, and 150 mLs of 100 N diluent oil are charged to the round bottom flask. While stirring at 400 rpm, 0.2 mole of $LiOH.H_2O$ is added at room temperature, then the mixture is heated over one hour to reflux at 14.2 psia, and maintained at this temperature until water evolution stops. Vacuum is adjusted slowly to 0.5 psia so as to avoid bumping. Distilling continues until all evolution of xylene stops, and some diluent oil begins collecting. The product is cooled and filtered to afford a bright oil which is diluted with 100 N neutral oil to 25 BN.

Example 6:125 BN Sulfurized Multi-Hydroxy Aromatic Compound

A four liter vessel with overhead stirrer, vacuum and nitrogen flow is charged with 1500 grams (5.36 moles) of propylene tetramer alkyl catechol, 850 grams of 100 N diluent oil, 273 grams (6.5 moles) of $LiOH.H_2O$, 275 grams (8.6 moles) of solid sulfur and 63 grams of 10% formic/90% acetic acid. The reaction mixture is heated to 180°°C. at 14.2 psia over three hours and held at this temperature for three hours. The vacuum is adjusted to one psia, and the reaction mixture distilled for 0.5 hour. The concentrate is cooled to 180° C., filtered over diatomaceous earth, and diluted to 125 BN with diluent oil.

Example 7:125 BN Hydroxy Aromatic Sulfonate

To a two liter, 4-necked round bottom flask is added 100 grams methanol, 480 grams xylene, 75 grams (1.75 moles) $LiOH.H_2O$. The resulting mixture is stirred for 10 minutes. Afterwards, 266 grams (0.5 mole) of $C_{20-24}$ alkylphenoxy sulfonic acid [3.1% CaS by Hyamine analysis—prepared in a manner similar to Example One, steps (a) and (b) of U.S. Pat. No. 5,330,663, which is incorporated herein by reference in its entirety for all purposes] is slowly added to the system over about a 1.5 hour period, while maintaining a maximum temperature of 31° C.

At this point, carbonation is initiated and approximately 27 grams (0.63 moles) of carbon dioxide is added over about three hours. Upon completion of the carbonation step, the system is heated to 93° C. over a two hour period and then heated to 132° C. over 30 minutes. At this point, 155 grams of diluent oil is added and the system heated to 204° C. over 1.5 hours under vacuum to remove xylene. The resulting solution is filtered over diatomaceous earth and diluted to 125 BN with diluent oil.

Example 8:191 BN Calcium/Lithium Phenate/ Salicylate Mixture

A four liter round bottom was equipped with a small reflux column able to support a pressure of four bars. The vessel was charged with 875 grams (3.24 moles) of $C_{12}$ branched alkylphenol, and 875 grams (2.24 moles) of $C_{20-24}$ linear alkylphenol. The mixture was stirred and warmed to 65° C., whereupon 158 grams (2.13 moles) of lime and 19 grams of a 50/50 weight mixture of formic/acetic acid was added. Heating was continued to 165° C. where water distillation began. The temperature was then increased to 220° C. while a vacuum was applied (50 mbar absolute). The reaction was held under these conditions for five hours. The reaction was then cooled to 200° C. and vacuum was broken slowly.

Next, the vessel was purged with carbon dioxide for ten minutes, and the apparatus was put under 3.5 bar of carbon dioxide; about 50 grams were introduced. The assembly was held at these conditions for five hours, then cooled to 165° C., returned to atmospheric pressure, further cooled to 120° C., and filtered to give a product with a BN of 115.

One Kilogram of this product was then added to a clean 4 liter flask and charged with 56 grams (1.33 moles) of $LiOH.H_2O$, 500 grams of 2-ethylhexanol, 0.2 grams of foam inhibitor, and heated to 150° C. within fifteen minutes under agitation. At this point, a vacuum of 50 mbar absolute was applied and the mixture stayed at these conditions for three hours, then heated further to 190° C. for thirty minutes. Vacuum was broken with nitrogen and the product was cooled and filtered to give a product with 191 BN. The lithium provided 76 BN.

Examples Showing Reduction in Black Sludge Deposits

Description of Black Sludge Deposit Test:

Some heavy fuel is introduced without homogenization in the test tube containing the lubricant sample. Then the glassware is put in an oxidation bath controlled at 175° C. and oxidized with an air flow. After 48 hours, the test tube is removed from the bath and after cooling, the oxidized oil-fuel mixture is collected in a beaker. After this pretreatment, a small portion of mixture is stored in a small beaker at 60° C. for 48 hours; prior to weighing the mixture into the beaker, a metal panel is placed on the bottom. After storage, the amount of sludge collected on the panel is determined.

Comparative Example A 125 BN Calcium Sulfurized Alkylphenate

A two liter vessel with overhead stirrer and nitrogen flow was charged with 1,391 grams of propylene tetramer alkylphenol, 842 grams 100 N diluent oil, 219 grams calcium hydroxide, 236 grams sulfur, and 90 grams of a catalyst mixture composed of 63 grams of 10% formic/90% acetic acid. The reaction mixture was heated to 205° C. over five hours. The temperature was held at 205° C. for three hours. At this point the pump was turned off and the mixture was distilled under vacuum at one psia for 0.5 hour. The concentrate was cooled to 180° C., filtered over diatomaceous earth, and diluted to 125 BN with diluent oil.

Example B 125 BN Calcium/Lithium Sulfurized Alkylphenate

A concentrate was prepared according to the procedures of Comparative Example A, except that a mixture of calcium hydroxide and lithium hydroxide was used instead of only calcium hydroxide. The resulting product had one third of its base from lithium, and two thirds from calcium, on a weight basis.

Example C 125 BN Lithium Sulfurized Alkylphenate

A concentrate was prepared according to the procedures of Comparative Example A, except that lithium hydroxide was used instead of calcium hydroxide.

Example D Black Sludge Deposit Test

Comparative Example A and Examples B and C, were tested using the procedure described above for the black sludge deposit test in a formulation (Baseline) also containing a lubricating oil, a 40 BN calcium-based phenate-salicylate, a succinimide, a zinc dialklyldithiophosphate, and a foam inhibitor. The amount of calcium-based phenate-salicylate present in the formulation was reduced to accommodate Comparative Example A and Examples B and C, while maintaining a constant 40 BN. The weight percent of deposits before and after washing are shown below:

| | Baseline | A | B | C |
|---|---|---|---|---|
| Wt % of Additive | | 2.62% | 4.72% | 1.59% |
| Before washing | 0.57 | 0.55 | 0.08 | 0.08 |
| After washing | 0.36 | 0.35 | 0.00 | 0.00 |

The above table shows that there is a dramatic improvement in black sludge deposits when at least one third of the base metal of the phenate is lithium, instead of calcium.

Examples Showing Reduction in Bench Test Deposits

Comparative Example A and Examples B and C, were tested in the formulation described above in a hot tube test using an 40 BN oil at 290° and 310° C. for 16 hours. The laquer ratings (10=Clear) are shown below:

| | Baseline | A | B | C |
|---|---|---|---|---|
| Wt % of Additive | | 2.62% | 4.72% | 1.59% |
| Lacquer @ 290° C. | 8.0 | 9.0 | 9.5 | 9.5 |
| Lacquer @ 310° C. | 5.5 | 6.5 | 9.0 | 9.0 |

The above table shows that there is a dramatic improvement in this piston deposit bench tests when at least one third of the base metal of the phenate is lithium, instead of calcium.

Examples Showing Reduction in Engine Deposits

Comparative Example A and C, were tested in the formulation described above in an AVL Caterpillar 1J using a 40 BN. oil. The undercrown deposit ratings (10 =Clear) are shown below:

| | Baseline | A | C |
|---|---|---|---|
| Weight % of Additive | | 1.6% | 1.6% |
| Undercrown Deposit | 1.3 | 3.0 | 8.1 |

The above table shows that there is a dramatic improvement in this piston deposit engine tests when the base metal of the phenate is lithium, instead of calcium. While the present invention has been described with reference to specific embodiments, this application is intended to cover those various changes and substitutions that may be made by those skilled in the art without departing from the spirit and scope of the appended claims.

What is claimed is:

1. A non-thixotropic lubricant additive comprising:

(a) from 10% to 50% of at least one liquid organic diluent; and (b) from 30% to 90% of an substituted hydrocarbaryl metal salt, wherein at least 30 mole percent of the metal in said salt is lithium;

wherein the BN of the non-thixotropic lubricant additive attributable to lithium is less than 150, and wherein said lubricant additive is essentially free of sodium.

2. A non-thixotropic lubricant additive according to claim 1 wherein said lubricant additive is essentially free of potassium.

3. A non-thixotropic lubricant additive according to claim 1 wherein at least 90 mole percent of the metal in said substituted hydrocarbaryl salt is lithium.

4. A non-thixotropic lubricant additive according to claim 3 wherein said substituted hydrocarbaryl metal salt is essentially free of other metals except lithium.

5. A non-thixotropic lubricant additive according to claim 1 wherein said substituted hydrocarbaryl metal salt is selected from the group consisting of:

(a) alkyl or alkenyl phenate;

(b) alkyl or alkenyl sulfurized phenate;

(c) alkyl or alkenyl aromatic sulfonate;

(d) alkyl or alkenyl salicylate;

(e) alkyl or alkenyl sulfurized salicylate;

(f) salt of alkyl or alkenyl multi-hydroxy aromatic compound;

(g) salt of alkyl or alkenyl sulfurized multi-hydroxy aromatic compound;

(h) alkyl or alkenyl hydroxy aromatic sulfonate; or (i) chemical or physical mixtures thereof.

6. A non-thixotropic lubricant additive according to claim 5 wherein said alkyl or alkenyl group has from 6 to 40 carbon atoms.

7. A non-thixotropic lubricant additive according to claim 5 wherein the aromatic moeity of said hydrocarbaryl group is either benzene or toluene.

8. A non-thixotropic lubricant additive according to claim 5 wherein said substituted hydrocarbaryl metal salt is an alkyl or alkenyl phenate or a sulfurized alkyl or alkenyl phenate.

9. A non-thixotropic lubricant additive according to claim 8 wherein said substituted hydrocarbaryl metal salt is a sulfurized alkylphenate composition prepared by the process comprising:

contacting an alkylphenol, having at least one alkyl substituent having from 6 to 36 carbon atoms, with sulfur, in the presence of:

(a) a promoter selected from the group consisting of:

(1) alkanoic acids having one, two, or three carbon atoms, and mixtures of said alkanoic acids, (2) lithium salts of said alkanoic acids, and (3) mixtures thereof, and (b) at least a stoichiometric amount of a lithium base sufficient to neutralize said alkylphenol and said carboxylic acid under reactive conditions, in the absence of a polyol promoter or an alcohol for a sufficient period of time to react essentially all of the sulfur thereby yielding a metal sulfurized alkylphenate reaction product mixture essentially free of elemental sulfur.

10. A non-thixotropic lubricant additive according to claim 5 wherein said substituted hydrocarbaryl metal salt is an alkyl or alkenyl aromatic sulfonate.

11. A non-thixotropic lubricant additive according to claim 5 wherein said substituted hydrocarbaryl metal salt is an alkyl or alkenyl salicylate or a sulfurized alkyl or alkenyl salicylate.

12. A non-thixotropic lubricant additive according to claim 5 wherein said substituted hydrocarbaryl metal salt is a metal salt of a multi-hydroxy alkyl or alkenyl aromatic compound, or a metal salt of a sulfurized multi-hydroxy alkyl or alkenyl aromatic compound.

13. A non-thixotropic lubricant additive according to claim 5 wherein said substituted hydrocarbaryl metal salt is a alkyl or alkenyl hydroxy aromatic sulfonate.

14. A non-thixotropic lubricant additive according to claim 1 further comprising up to 60% of a Group II metal-containing detergent.

15. A non-thixotropic lubricant additive according to claim 14 wherein the Group II metal of said detergent is selected from the group consisting of calcium, magnesium, and chemical and physical mixtures thereof.

16. A non-thixotropic lubricant additive according to claim 14 wherein said Group II metal-containing detergent is selected from the group consisting of:

(a) an alkyl or alkenyl phenate;

(b) a sulfurized alkyl or alkenyl phenate;

(c) an alkyl or alkenyl aromatic sulfonate;

(d) an alkyl or alkenyl salicylate;

(e) a sulfurized alkyl or alkenyl salicylate;

(f) an alkyl or alkenyl naphthenate;

(g) a sulfurized alkyl or alkenyl naphthenate;

(h) a metal salt of a multi-hydroxy alkyl or alkenyl aromatic compound;

(i) a metal salt of a sulfurized multi-hydroxy alkyl or alkenyl aromatic compound;

(j) an alkyl or alkenyl hydroxy aromatic sulfonate;

(k) a metal salt of an alkanoic acid;

(l) a sulfurized metal salt of an alkanoic acid;

(m) a metal salt of an alkyl or alkenyl multiacid;

(n) a sulfurized metal salt of alkyl or alkenyl multiacid; and (o) chemical and physical mixtures thereof.

17. A concentrate comprising the non-thixotropic lubricant additive of claim 1, an organic diluent, and at least one of the following:

(a) an ashless dispersant (b) an oxidation inhibitor;

(c) a rust inhibitor;

(d) a demulsifier;

(e) an extreme pressure agent;

(f) a friction modifier;

(g) a multifunctional additive;

(h) a viscosity index improver;

(i) a pour point depressant; and (j) a foam inhibitor;

wherein the total level of organic diluent is from 20% to 80% of the total concentrate.

18. A concentrate according to claim 17 comprising a zinc dialkyldithiophosphate.

19. A concentrate according to claim 17 comprising an alkenyl succinimide ashless dispersant.

20. A concentrate according to claim 19 comprising a zinc dialkyldithiophosphate.

21. A lubricating oil composition comprising a major amount of an oil of lubricating viscosity and a minor amount of the non-thixotropic lubricant additive of claim 1.

22. A method of decreasing black sludge deposits between moving metal parts in internal combustion engines, said method comprising lubricating said engines with the lubricating oil composition according to claim 21.

23. A method of decreasing piston deposits in internal combustion engines, said method comprising lubricating said engines with the lubricating oil composition according to claim 21.

24. A lubricating oil composition comprising:

(a) a major amount of a base oil of lubricating viscosity;

(b) from 1% to 20% of at least one ashless dispersant;

(c) from 1% to 40% of the non-thixotropic lubricant additive of claim 1;

(d) from 0.05% to 5% of at least one zinc dithiophosphate;

(e) from 0.0% to 10% of at least one oxidation inhibitor;

(f) from 0.0% to 1% of at least one foam inhibitor; and (g) from 0.0% to 20% of at least one viscosity index improver.

25. A non-thixotropic lubricant additive comprising:

(a) from 10% to 50% of at least one liquid organic diluent; and (b) from 30% to 90% of a lithium sulfurized alkyl or alkenyl phenate, wherein said alkyl or alkenyl group has from 6 to 40 carbon atoms, and wherein said sulfurized alkyl or alkenyl phenate is essentially free of other metals;

wherein the BN of the non-thixotropic lubricant additive attributable to the lithium less than 150, and wherein said lubricant additive is essentially free of sodium.

26. A non-thixotropic lubricant additive according to claim 25 further comprising up to 60% of a calcium-containing detergent selected from the group consisting of a sulfurized alkyl or alkenyl phenate, an alkyl or alkenyl benzene sulfonate, and an alkyl or alkenyl toluene sulfonate, wherein said alkyl or alkenyl group has from 6 to 40 carbon atoms.

27. A lubricating oil composition comprising a major amount of an oil of lubricating viscosity and minor amounts of a zinc dialkyldithiophosphate, an alkenyl succinimide ashless dispersant, and the non-thixotropic lubricant additive of claim 26.

28. A method of decreasing black sludge deposits, said method comprising using the lubricating oil composition according to claim 27.

29. A method of decreasing piston deposits, said method comprising using the lubricating oil composition according to claim 27.

30. A concentrate comprising the non-thixotropic lubricant additive of claim 26, an organic diluent, and at least one of the following:

(a) an ashless dispersant (b) an oxidation inhibitor;

(c) a rust inhibitor;

(d) a demulsifier;

(e) an extreme pressure agent;

(f) a friction modifier;

(g) a multifunctional additive;

(h) a viscosity index improver;

(i) a pour point depressant; and (j) a foam inhibitor;

wherein the total level of organic diluent is from 20% to 80% of the total concentrate.

31. A process for producing a lubricating oil composition comprising blending a mixture comprising:

(a) a major portion of an oil of lubricating viscosity essentially free of sodium;

(b) from 1% to 25% of a lithium sulfurized alkyl or alkenyl phenate, which is essentially free of other metals, wherein said alkyl or alkenyl group has from 6 to 40 carbon atoms;

(c) from 1% to 25% calcium-containing detergent selected from the group consisting of a sulfurized alkyl or alkenyl phenate, an alkyl or alkenyl benzene sulfonate, and an alkyl or alkenyl toluene sulfonate, wherein said alkyl or alkenyl group has from 6 to 40 carbon atoms, wherein said calcium-containing detergent is essentially free of sodium;

(d) from 0.05% to 5% of a zinc dialkyidithiophosphate and;

(e) from 1% to 25% of an alkenyl succinimide ashless dispersant;

wherein the BN of the lubricating oil composition attributable to the lithium is less than 150.

32. A lubricating oil composition produced by the process according to claim 31.

* * * * *